US006580216B1

(12) United States Patent
Lu et al.

(10) Patent No.: US 6,580,216 B1
(45) Date of Patent: Jun. 17, 2003

(54) HIGH CONTRAST PDP AND A METHOD FOR MAKING THE SAME

(75) Inventors: Jin-Yuh Lu, Miaoli (TW); Wen-Fa Sung, Hsinchu (TW); Chun-Chin Huang, Taichung (TW); Ta-Yuan Lee, Taipei (TW)

(73) Assignee: Au Optronics Corp., Hsinchu (TW)

( * ) Notice: Subject to any disclaimer, the term of this patent is extended or adjusted under 35 U.S.C. 154(b) by 0 days.

(21) Appl. No.: 09/574,699

(22) Filed: May 18, 2000

(30) Foreign Application Priority Data

Aug. 31, 1999 (TW) ..... 088114929 A

(51) Int. Cl.[7] ..... H01J 17/49; H01J 9/24; H01J 9/18

(52) U.S. Cl. ..... 313/582; 313/584; 313/587; 313/586; 445/24; 445/33

(58) Field of Search ..... 313/582, 586–587, 313/492; 445/33, 24

(56) References Cited

U.S. PATENT DOCUMENTS 5,818,168 A * 10/1998 Ushifusa et al. ..... 313/582
5,952,782 A * 9/1999 Nanto et al. ..... 313/582
6,410,214 B1 * 6/2002 Kim ..... 430/321

* cited by examiner

*Primary Examiner*—Nimeshkumar D. Patel
*Assistant Examiner*—German Colón
(74) *Attorney, Agent, or Firm*—Ladas & Parry

(57) ABSTRACT

Disclosed is a high contrast PDP, comprising a glass substrate, shielding masks, patterned black matrices, transparent electrodes, display electrodes, a dielectric layer, an MgO layer. A black matrix layer is formed on the discharge region and the non-discharge region of the glass substrate and defined into shielding matrices and patterned black matrices respectively. Transparent electrodes are formed on the shielding mask, and display electrodes are formed on the transparent electrodes. The dielectric layer and MgO layer are sequentially formed over the whole glass substrate. The black matrix layer can consist of $Cr/Cr_2O_3$, $Fe/Fe_2O_3$ or black low melting-point glass. The transparent electrodes can consist of ITO or stannic oxide. The display electrodes can consist of Cr/Cu/Al, Cr/Al/Cr or Ag. The dielectric layer can consist of lead oxide or silicon oxide.

25 Claims, 12 Drawing Sheets

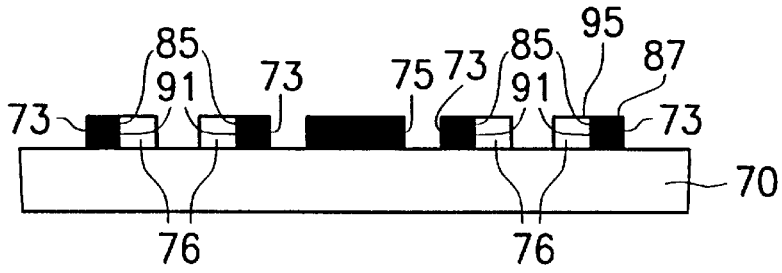
FIG. 6D"
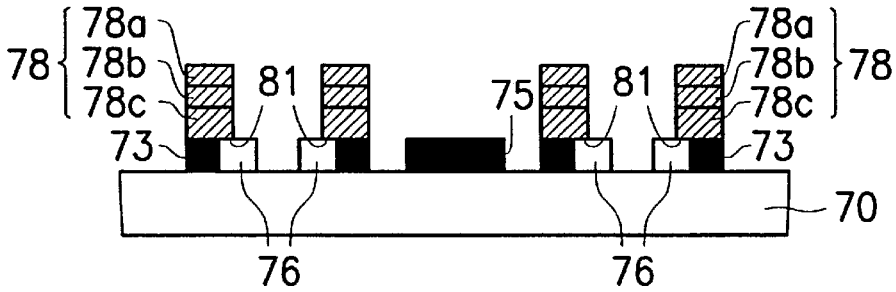
FIG. 6E"
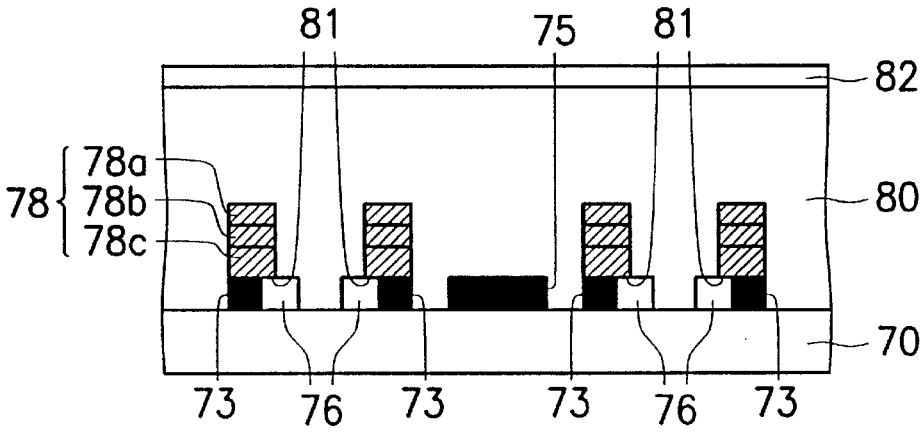
FIG. 6F"

HIGH CONTRAST PDP AND A METHOD FOR MAKING THE SAME

BACKGROUND OF THE INVENTION

1. Field of the Invention

This present invention relates to a display and a method for making the same, and in particular relates to a high contrast plasma display panel (PDP) and a method for making the same.

2. Description of the Prior Art

PDP uses the UV light emitted by a gas arc to excite red, green and blue phosphorous materials and generate visible light when the excited phosphorous materials return to ground state. FIG. 1A is a schematic view of the traditional PDP with electrodes, and FIG. 1B illustrates the cross-sectional view of a discharge cell of the PDP shown in FIG. 1A. As shown in FIGS. 1A and 1B, the electrodes are arrayed on a matrix consisting of vertical and horizontal stripes set on the glass substrates 1 and 2. One set of the electrodes is the address electrode 3 for the display data to write therein. Another set of the electrodes is the display electrodes 4, which is used to discharge and display. Between the display electrodes is discharge region. The region which is not covered by the discharge region is a non-discharge region. The address electrodes 3 are separated by ribs 5, and the red, green, blue phosphorous materials are coated on the glass substrate 1 to cover the address electrodes 3. The display panel is formed by joining the rear glass substrate 1 with the front glass substrate 2, and the space between the glass substrates 1 and 2 are filled with a mixing gas consisting of Ne and Ar. Each intersection of an address electrode 3 and a pair of display electrodes 4 is a discharge cell. The data written into the address electrode 3 are transformed and transferred to the display panel by discharging between the display electrodes 4. By controlling the discharge intensity of the display electrodes 4, the intensity of the emission light can be controlled and the display panel can show true color symbols, drawings and images.

The brightness and the contrast are both important properties for PDP. The definition of contrast is the ratio of the brightness level to the darkness level. As shown in FIG. 2, during operation, the PDP has a little background radiation even in full dark state. Therefore, the definition of contrast in a dark room (dark-room contrast) is the ratio of intensity of display light (Ld) over the intensity of background radiation (Lb):

$$\text{Dark-room contrast}=Ld/Lb$$

Next, consider a light environment (such as indoor illumination). Let the intensity of incident light be Lin, and the reflection coefficient of the glass substrate be $\alpha$. Let the the intensity of reflecting light be Lref, then Lref=$\alpha$Lin. The contrast in a light room (light-room contrast) is amended as the following formula:

$$\text{Light-room contrast}=(Ld+Lref)/(Lb+Lref)$$

Therefore, decreasing the intensity of the reflecting light is necessary to enhance light-room contrast.

To reduce the intensity of reflection and improve the contrast in a light room, a non-transparent black matrix (BM) is introduced to the front panel of the PDP to cover the non-discharge region of PDP.

FIGS. 3A~3G are cross-sectional views showing one process in the prior art for improving the light-room contrast by introducing black matrices onto the front panel of the PDP. In this example, black matrices are introduced into to the front panel of the PDP to improve the light-room contrast.

As shown in FIG. 3A, a glass substrate 10 is provided first. Then, transparent electrodes 12 are formed on the discharge region of the glass substrate 10 as shown in FIG. 3B. The transparent electrodes 12 usually consist of indium tin oxide (ITO). Then, display electrodes 14 are formed on top of the transparent electrode 12 as shown in FIG. 3C. The display electrodes usually consist of Cr/Cu/Cr or Cr/Al/Cr. A planarized dielectric layer 16 is deposited as shown in FIG. 3D. Then, black matrices 18 are formed on top of the dielectric layer 16 in areas corresponding to non-discharge region of PDP as shown in FIG. 3E. The black matrices 18 usually consist of black low melting-point glass. Then, a sealing frit 20 is formed on top of the dielectric layer 16 in the peripheral PDP. For illustration purpose, the sealing frit is shown next to the black matrix in FIG. 3F. Afterwards, a MgO layer 22 is formed as shown in FIG. 3G.

FIGS. 4A~4F are cross-sectional views showing another process for improving the light-room contrast by introducing a black matrix onto the front panel of the PDP.

As shown in FIG. 4A, a glass substrate 30 is provided first. Then, transparent electrodes 32 are formed on the discharge region of the glass substrate 30 as shown in FIG. 4B. The transparent electrodes 32 usually consist of indium tin oxide (ITO). Then, display electrodes 34 are formed on top of the transparent electrodes 32, and black matrices 36 are formed on the non-discharge region of the PDP as shown in FIG. 4C. Then, a planarized dielectric layer 38 is deposited as shown in FIG. 4D. Then, a sealing frit 40 is formed on top of the dielectric layer 38 in the peripheral PDP as shown in FIG. 4E.

Afterwards, a MgO layer 42 is formed on the exposed dielectric layer 38 as shown in FIG. 4F.

Similarly, FIGS. 5A~5F shows another example, wherein black matrices are introduced into to the front panel of PDP to improve the light-room contrast.

As shown in FIG. 5A, a glass substrate 50 is provided first. Then, transparent electrodes 52 are formed on the discharge region of the glass substrate 50 as shown in FIG. 5B. The transparent electrodes 52 usually consist of indium tin oxide (ITO). Then, display electrodes 54 are formed on top of the transparent electrodes 52, as shown in FIG. 5C. The display electrodes usually consist of Cr/Cu/Cr or Cr/Al/Cr. Then, a planarized dielectric layer 56 is deposited as shown in FIG. 5D. Black matrices 58 are formed on top of the dielectric layer 56 which corresponds to non-discharge region of PDP as shown in FIG. 5E, wherein the black matrices 58 usually consists of black low melting-point glass. Then, another dielectric layer 60 is deposited as shown in FIG. 5F. Then, a sealing frit 62 is formed on top of the dielectric layer 60 in the peripheral PDP as shown in FIG. 5G. Afterwards, a MgO layer 64 is formed on the exposed dielectric layer 60 as shown in FIG. 5H.

In the above-mentioned examples, the surface reflectance of the black matrices (18, 36, 58) consisting of either Cr/Cu/Cr or Cr/Al/Cr may reach as high as 60%.

SUMMARY OF THE INVENTION

One object of this present invention is to provide a high contrast PDP and a method for making the same to reduce the surface reflectance of the black masks, thus the intensity of the reflection can be reduced. Consequently, the light-room contrast is improved.

Another object of this invention is to provide a high contrast PDP and a method for making the same, which is characterized by that shielding masks formed of black matrix material below the display electrodes. Compared with the traditional PDP, the area covered by the black matrix material within this present PDP is increased, thereby the reflection intensity of PDP is reduced.

Another object of this invention is to provide a high contrast PDP, and a method for making the same. The reflection intensity can be reduced and the light-room contrast can be improved without extra processes or cost.

BRIEF DESCRIPTION OF THE DRAWINGS

The present invention will become more fully understood from the detailed description given hereinbelow and the accompanying drawings, given by way of illustration only and thus not intended to be limitative of the present invention.

FIGS. 6D'~6F' are cross-sectional views showing the process of fabricating a PDP according to a second embodiment of the present invention; and FIGS. 6D"~6F" are cross-sectional views showing the process of fabricating a PDP according to a third embodiment of the present invention.

DETAILED DESCRIPTION OF THE INVENTION

In order to achieve the above-mentioned objects, this present invention provides a high contrast PDP consisting of a glass substrate, shielding masks, black matrices, transparent electrodes, display electrodes, a dielectric layer, and an MgO layer. The black matrix material is formed on the discharge region and the non-discharge region of the glass substrate. Those black matrices formed on the discharge region are called shielding masks in this invention. The transparent electrodes are formed on the surface of the shielding masks. The display electrodes are formed on the surface of the transparent electrodes. Then the dielectric layer and the passivation layer (e.g. MgO) are deposited.

The present invention discloses a novel method for making a high contrast PDP. According to this method, a glass substrate is provided first, then a black matrix layer formed of black matrix material is formed on the non-discharge region and the discharge region of the glass substrate and defined to form shielding masks and patterned black matrices to separate various image discharge cells. Then, transparent electrodes are formed on the sheilding masks. Afterwards, a display electrode is formed on the transparent electrode, and a dielectric layer and a MgO layer are deposited on the glass substrate sequentially. Compared with the traditional PDP, the non-discharge region and the discharge region of this present PDP are covered by the patterned black matrices and the shielding masks respectively. The use of the shielding masks and the patterned black matrices decreases the reflection intensity and the light-room contrast.

The black matrix layer can consist of $Cr/Cr_2O_3$ or $Fe/Fe_2O_3$ or black low melting-point glass. The transparent electrodes can consist of ITO or stannic oxide. The display electrodes can consist of Cr/Cu/Cr, Cr/Al/Cr or Ag. The dielectric layer can consist of lead oxide or silicon oxide.

Embodiment of the Invention

Because light-room contrast is directly affected by the surface reflectance of the black matrix materials, this present invention uses $Cr/Cr_2O_3$ or $Fe/Fe_2O_3$ black matrix materials with a surface reflectance less than 20% instead of Cr/Cu/Cr or Cr/Al/Cr black matrix materials.

Embodiment 1

FIGS. 6A~6F are cross-sectional views showing the process of fabricating a PDP according to a first embodiment of the present invention.

Figure 1A:
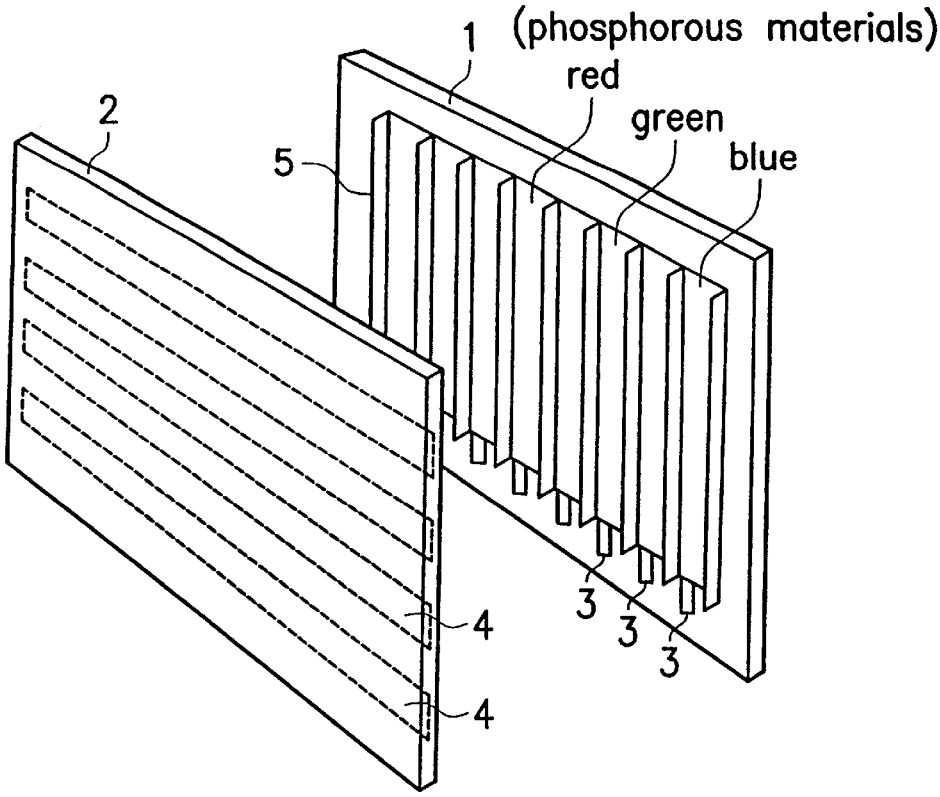
FIG. 1A (PRIOR ART)
FIG. 1A is a schematic view showing the triple electrodes of the traditional PDP.
Figure 1B:
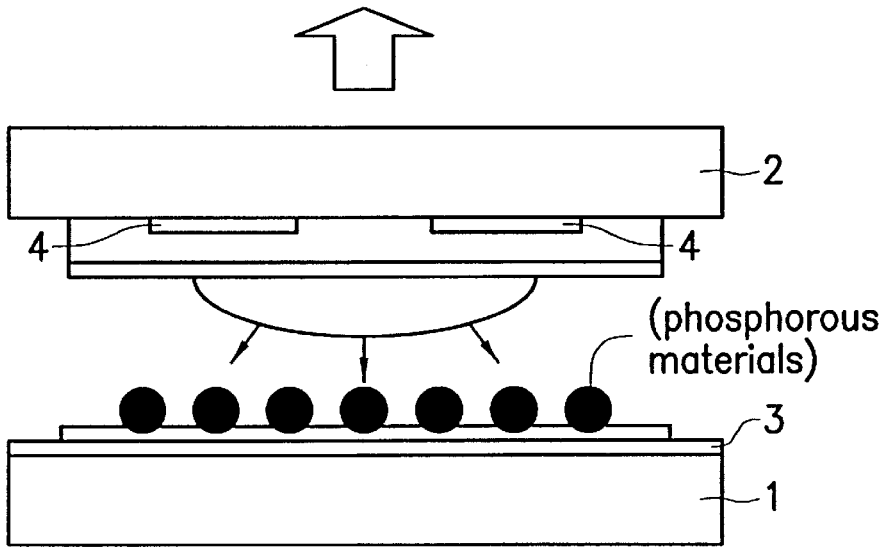
FIG. 1B (PRIOR ART)
FIG. 1B illustrates the discharge state of the surface of the PDP shown in FIG. 1A.
Figure 2:
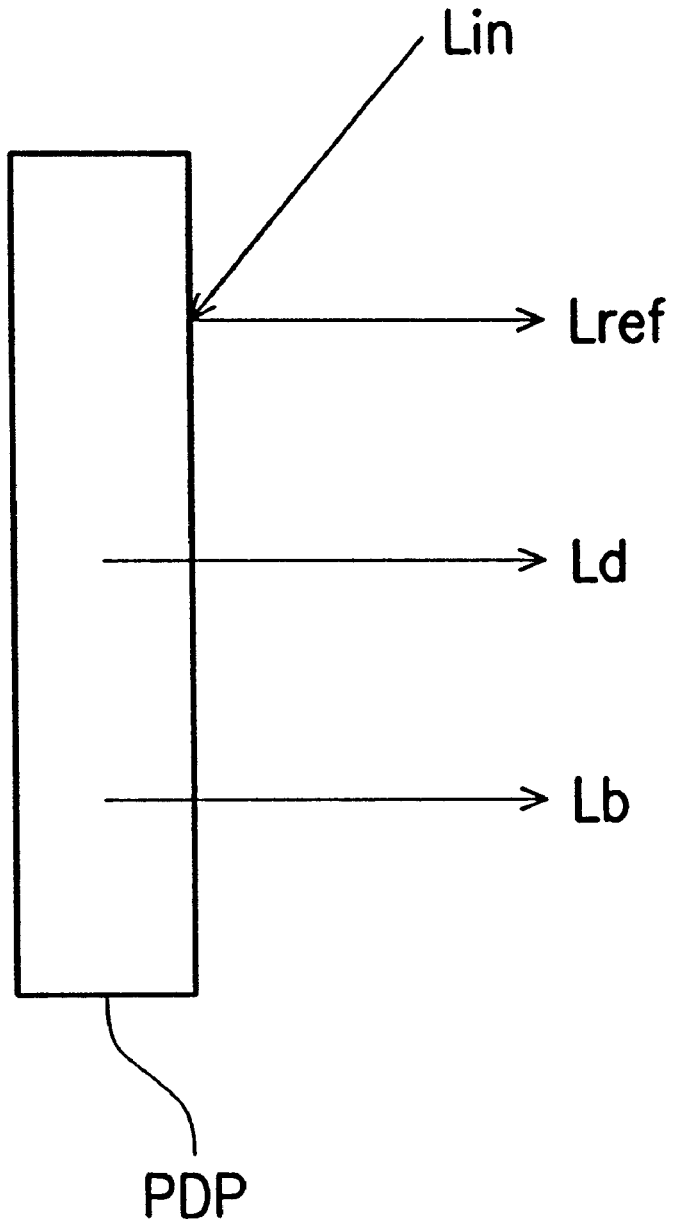
FIG. 2 (PRIOR ART)
FIG. 2 is a schematic view showing the contrast of the PDP.
Figure 3A:
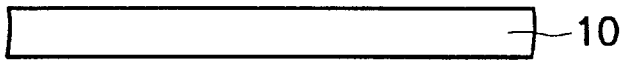
FIG. 3A (PRIOR ART)
FIGS. 3A~3G are cross-sectional views showing one process in the prior art for improving light-room contrast by introducing black matrices onto the front panel of the PDP.
Figure 3B:
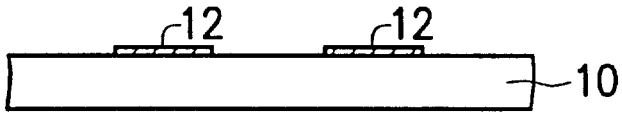
FIG. 3B (PRIOR ART)
Figure 3C:
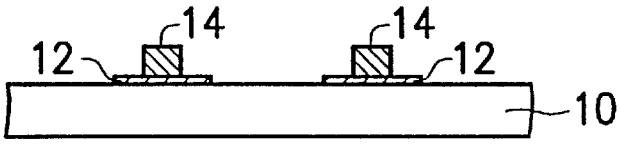
FIG. 3C (PRIOR ART)
Figure 3D:
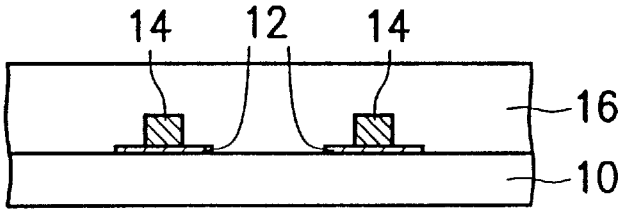
FIG. 3D (PRIOR ART)
Figure 3E:
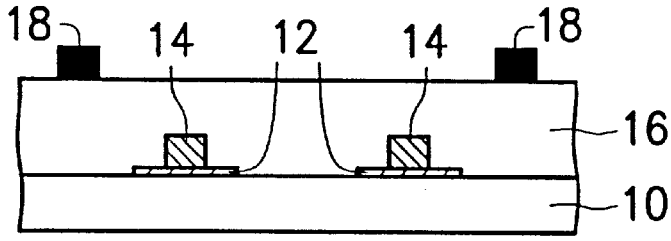
FIG. 3E (PRIOR ART)
Figure 3F:
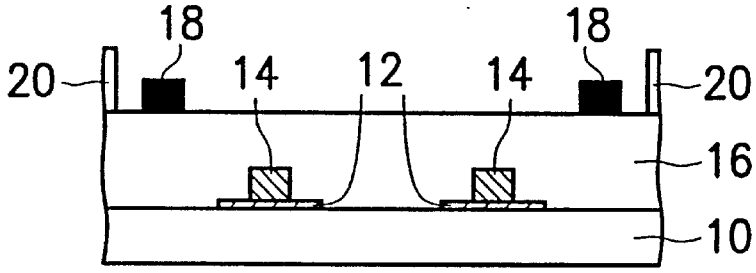
FIG. 3F (PRIOR ART)
Figure 3G:
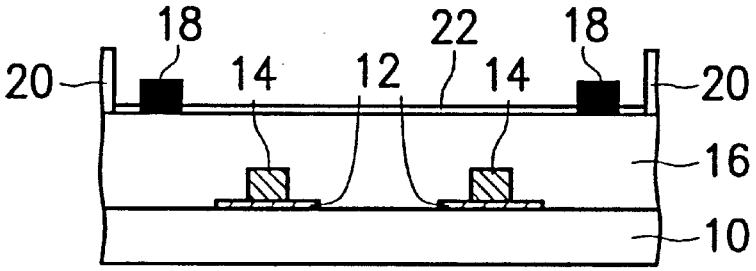
FIG. 3G (PRIOR ART)
Figure 4A:
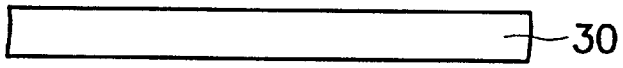
FIG. 4A (PRIOR ART)
FIGS. 4A~4F are cross-sectional views showing another process for improving light-room contrast by introducing a black matrix onto the front panel of the PDP.
Figure 4B:
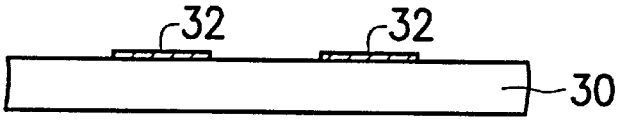
FIG. 4B (PRIOR ART)
Figure 4C:
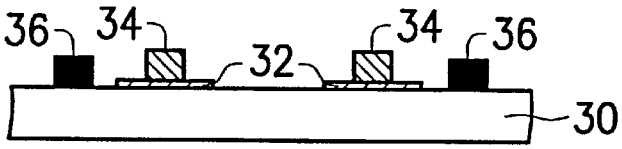
FIG. 4C (PRIOR ART)
Figure 4D:
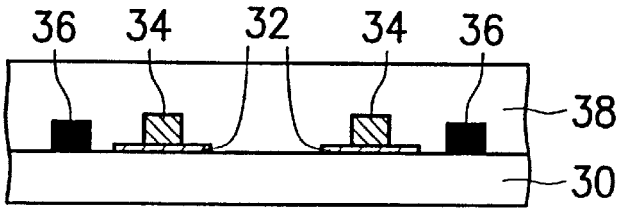
FIG. 4D (PRIOR ART)
Figure 4E:
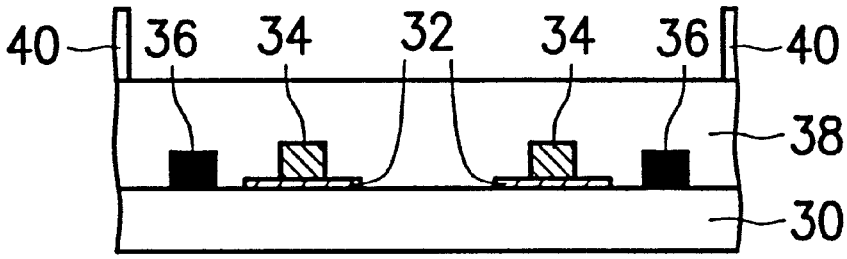
FIG. 4E (PRIOR ART)
Figure 4F:
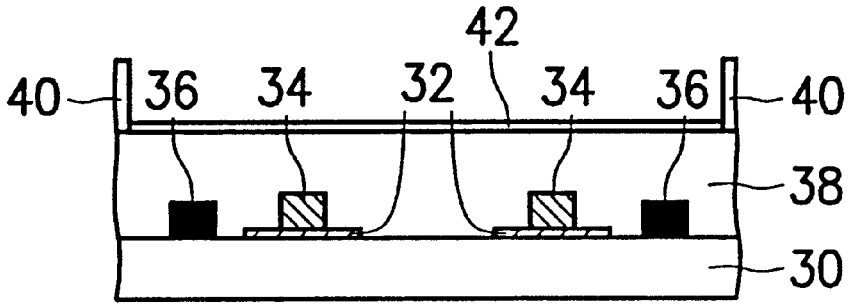
FIG. 4F (PRIOR ART)
Figure 5A:
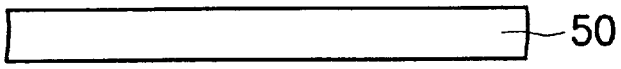
FIG. 5A (PRIOR ART)
FIGS. 5A~5H are cross-sectional views showing still another process for improving light-room contrast by introducing a black matrix onto the front panel of the PDP.
Figure 5B:
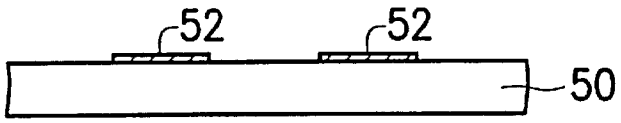
FIG. 5B (PRIOR ART)
Figure 5C:
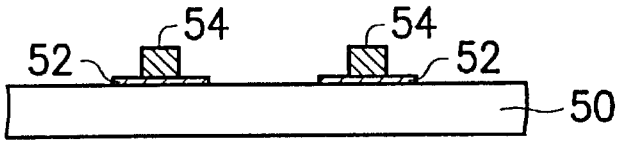
FIG. 5C (PRIOR ART)
Figure 5D:
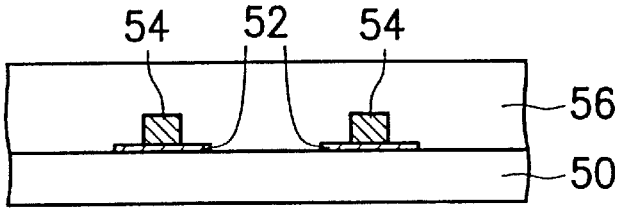
FIG. 5D (PRIOR ART)
Figure 5E:
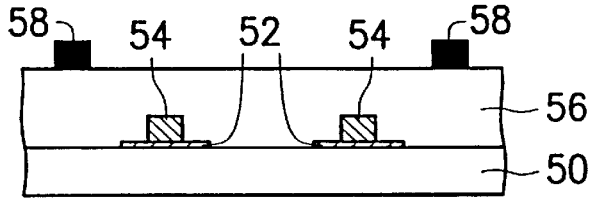
FIG. 5E (PRIOR ART)
Figure 5F:
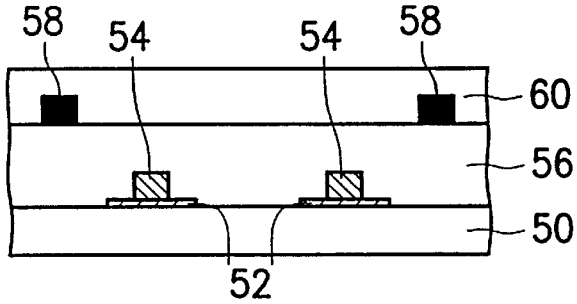
FIG. 5F (PRIOR ART)
Figure 5G:
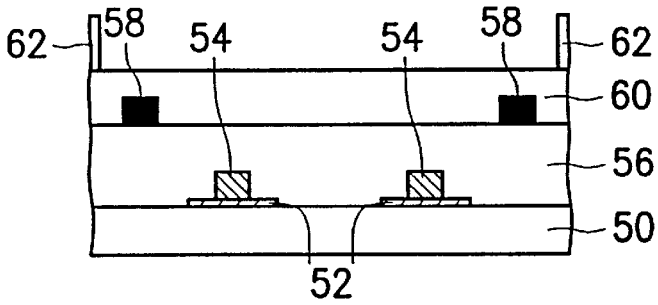
FIG. 5G (PRIOR ART)
Figure 5H:
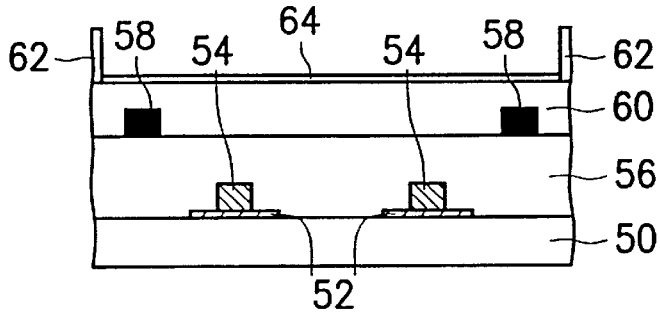
FIG. 5H (PRIOR ART)
Figure 6A:
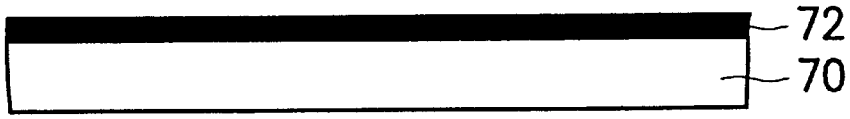
FIGS. 6A~6F are cross-sectional views showing the process of fabricating a PDP according to a first embodiment of the present invention.

Referring to FIG. 6A, a glass substrate 70 is provided, then a black matrix layer 72 consisting of either $Cr/Cr_2O_3$ or $Fe/Fe_2O_3$ with a thickness of about 1K~2K Å is formed on the glass substrate 70.

Figure 6B:
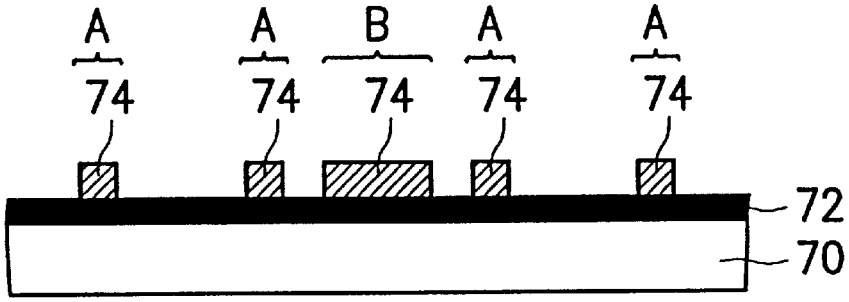

Refer to FIG. 6B. By way of photolithography, the photoresist layer is patterned into a desired photoresist pattern 74 overlaying a predetermined regions A for forming shielding masks 73 and regions B for forming patterned black matrices 75. Using the photoresist pattern 74 as a mask, the black matrix layer 72 unshielded by the photoresist pattern 74 is etched by wet etching using Cr-7 as an etchant. Therefore, only the black matrix layer 72 within the predetermined regions A for forming shielding masks 73 and regions B for forming patterned black matrices 75 is left. The shielding masks 73 have top surfaces 77.

While in this preferred embodiment the shielding masks 73 and the patterned black matrices 75 are formed simultaneously, it is understood that the shielding masks 73 can be formed first, followed by forming the patterned black matrices 75 by means of another mask and photolithography, or vice-versa.

Figure 6C:
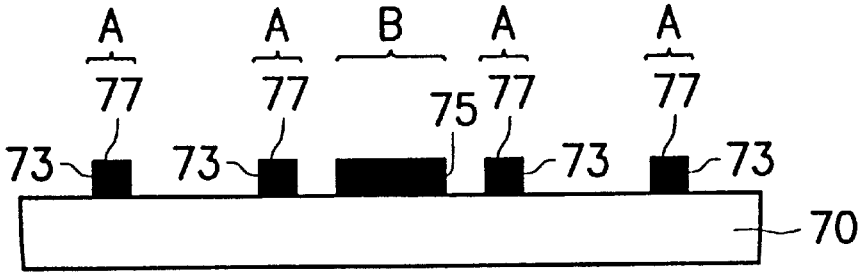
Figure 6D:
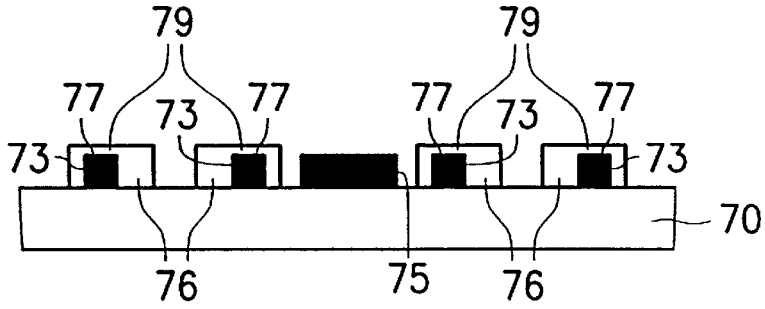

Then, referring to FIG. 6D, transparent electrodes 76 are formed on the discharge region A of the shielding masks 73, wherein the transparent electrodes 76 have a lateral extention 79 overlaying on the top surfaces 77 of the shielding masks 73. The transparent electrodes 76 are formed by sputtering an ITO with a thickness of about 1500 Å on top the patterned black matrices 75 and the shielding masks 73, then the ITO is patterned by photolithography and etching processes using an etchant consisting of $FeCl_3$ and HCl.

Figure 6E:
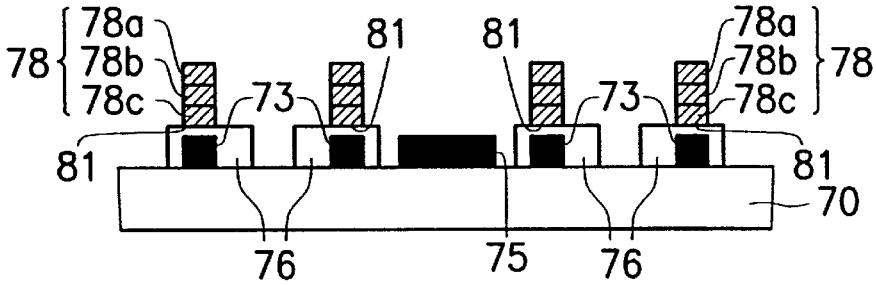

Referring to FIG. 6E, display electrodes 78 are formed on the lateral extention 79 of the transparent electrodes 76. Since the bottoms 81 of the display electrodes 78 are shielded by the shielding masks 73, the reflection from the bottoms 81 of the display electrodes 78 can be reduced. In this embodiment a Cr layer 78*a* with a thickness ranging from 1K~2K Å, a Cu(Al) layer 78*b* with a thickness ranging from 2~3 $\mu$m, and a Cr layer 78*c* with a thickness ranging from 1K~2K Å are sputtered on the transparent electrodes 76 sequentially, then these three metal layers 78*a*~78*c* are patterned into desired display electrodes 78 by way of photolithography and etching processes.

Figure 6F:
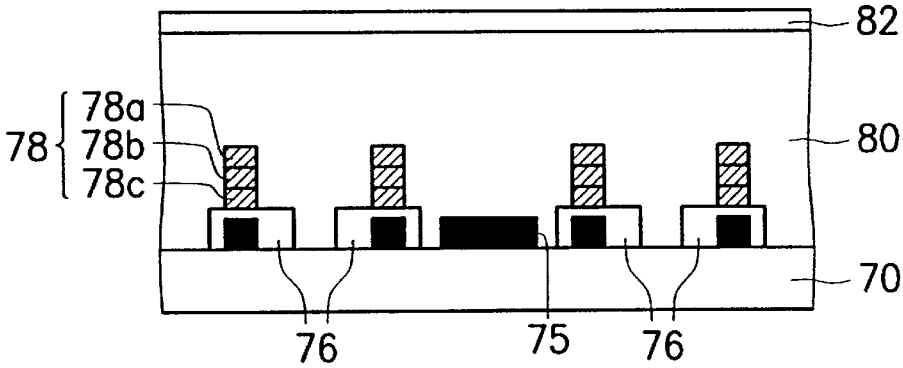
Figure 6D:
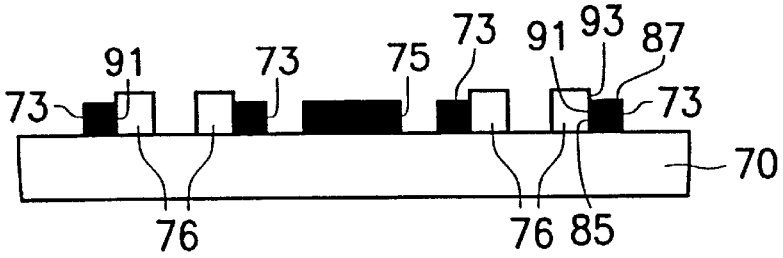
Figure 6E:
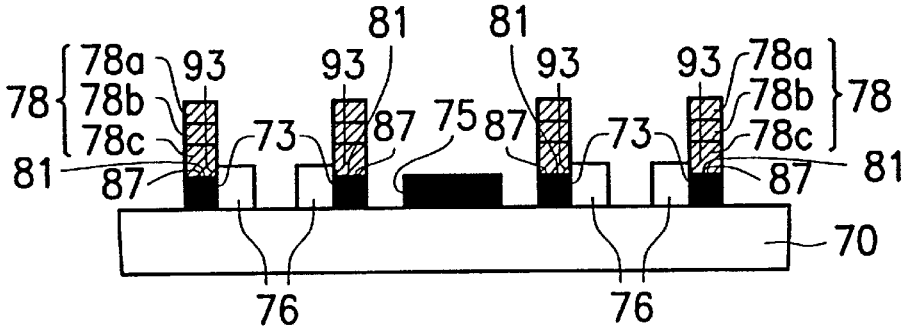
Figure 6F:
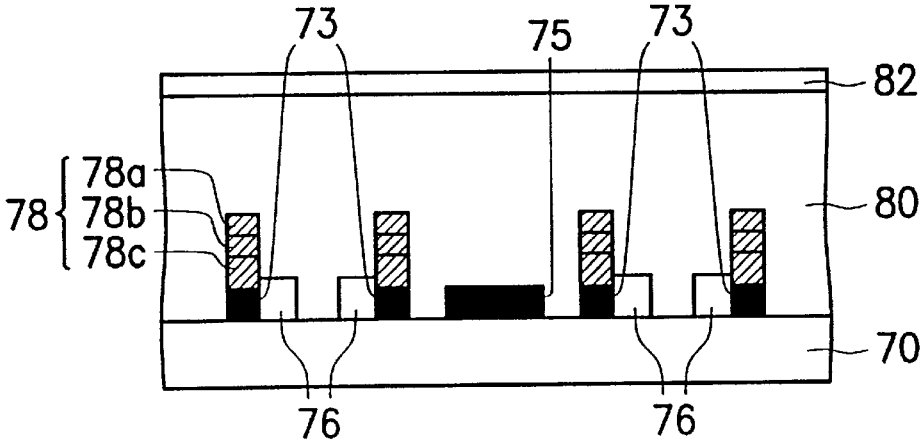

Referring to FIG. 6F, a dielectric layer 80 (such as lead oxide or silicon oxide) with a thickness of about 30 $\mu$m is formed to cover the patterned black matrices 75, the transparent electrodes 76, the shielding masks 73 and the display electrodes 78. Then, a passivation layer 82 (such as MgO) with a thickness of about 5,000~10,000 Å is deposited on the dielectric layer 80. Thereby, a PDP is generated.

Embodiment 2

The first three steps of this embodiment are the same as those illustrated in FIGS. 6A~6C of Embodiment 1. However, the processes illustrated in FIGS. 6D~6F are amended as shown in FIGS. 6D'~6F'.

As shown in FIG. 6D', each the shielding masks 73 on the glass substrate 70 have a side wall 85 and a top surface 87. Transparent electrodes 76, each with a side wall 91 adjoining with the side wall 85 of the corresponding shielding masks 73, are formed on the glass substrate 70. The height of the side wall 91 is higher than that of the side wall 85, thereby part of the side wall 91 of the transparent electrodes 76 stands out to form an outstanding surface 93. The transparent electrodes 76 are made according to the same processes described above.

Referring to FIG. 6E', display electrodes 78 are formed on the top surfaces of the shielding masks 73, the display electrodes 78 being connected and thus conducted to the outstanding surface 93 of the side wall of the transparent electrodes 76. Since the bottoms 81 of the display electrodes 78 are shielded 81 by the shielding masks 73, the reflection of the bottoms 81 of the display electrodes 78 are reduced. The processes for making the display electrodes 78 are the same as those described in FIG. 6E.

Referring to FIG. 6F', a dielectric layer 80 and a passivation layer 82 are then deposited. The processes herein are the same as those described in FIG. 6F.

Embodiment 3

The first three steps of this embodiment are the same as those illustrated in FIGS. 6A~6C of Embodiment 1. However, the processes illustrated in FIGS. 6D~6F are amended as shown in FIGS. 6D"~6F".

As shown in FIG. 6D", each of the shielding masks 73 on the glass substrate 70 has a side wall 85 and a top surface 87. Transparent electrodes 76, each having a side wall 91 adjoining with the side wall 85 of the corresponding shielding masks 73, and a top surface 95, is formed on the glass substrate 70. The transparent electrodes 76 are made according to the same processes illustrated in FIG. 6D.

Referring to FIG. 6E", display electrodes 78 are formed on the region including the top surfaces 87 of the shielding masks 73 and part of the top surface 95 of the transparent electrodes 76. The display electrodes 78 are connected and thus conducted to the top surfaces 95 of the transparent electrodes 76. Since the bottoms 81 of the display electrodes 78 are shielded by the shielding masks 73, the reflection of the bottoms 81 of the display electrodes 78 is reduced. The processes for making the display electrodes 78 are the same as those described in FIG. 6E.

Referring to FIG. 6F", a dielectric layer 80 and a passivation layer 82 are then deposited. The processes herein are the same as those described in FIG. 6F.

The foregoing description of the preferred embodiments of this invention has been presented for purposes of illustration and description. Obvious modifications or variations are possible in light of the above teaching. The embodiments are chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

What is claimed is:

1. A method for making a PDP, comprising the steps of:

(a) providing a glass substrate;

(b) forming a shielding mask on the glass substrate, wherein the shielding mask has a top surface and a first side wall;

(c) forming a transparent electrode on the glass substrate, the transparent electrode having a second side wall, wherein the second side wall of the transparent electrode is adjoined with the first side wall of the shielding mask, and the second side wall of the transparent electrode is higher than the first side wall of the shielding mask, such that the second side wall of the transparent electrode has an outstanding surface;

(d) forming a display electrode on the top surface of the shielding mask, the display electrode contacting the outstanding surface of the transparent electrode, wherein the bottom of the display electrode is shielded by the shielding mask to reduce reflection thereof.

2. The method as claimed in claim 1, wherein the step (b) further comprises simultaneously forming a patterned black matrix on the glass substrate to separate various discharge cells.

3. The method as claimed in claim 1, further comprising, after step (d), a step (e) of forming a dielectric layer to cover the glass substrate, the shielding mask, the transparent electrode and the display electrode.

4. The method as claimed in claim 1, further comprising, after step (e), a step (f) of forming a passivation layer on the dielectric layer.

5. A process for making a PDP, comprising the steps of:

(a) providing a glass substrate;

(b) forming a shielding mask on the glass substrate, wherein the shielding mask has a first side wall and a first top surface;

(c) forming a transparent electrode on the glass substrate, the transparent electrode having a second side wall and a second top surface, wherein the second side wall of the transparent electrode is adjoined with the first side wall of the shielding mask; and (d) forming a display electrode overlying both the first top surface of the shielding mask and the second top surface of the transparent electrode, wherein the display electrode has a first bottom portion overlaying the shielding mask and not overlying the transparent electrode, and a second bottom portion overlaying the transparent electrode and not overlaying the shielding mask, and wherein the display electrode electrically conducts to the second top surface of the transparent electrode.

6. The method as claimed in claim 5, wherein the step (b) further comprising simultaneously forming a patterned black matrix on the glass substrate to separate various discharge cells.

7. The method as claimed in claim 5, further comprising, after step (d), step (e) forming a dielectric layer to cover the glass substrate, the shielding mask, the transparent electrode and the display electrode.

8. The method as claimed in claim 7, further comprising, after step (e), step (f) forming a passivation layer on the dielectric layer.

9. A plasma display panel (PDP), comprising:

a glass substrate;

a shielding mask formed on the glass substrate, the shielding mask having a top surface and a first side wall;

a transparent electrode having a second side wall formed on the glass substrate, wherein the second side wall of the transparent electrode adjoins the first side wall of the shielding mask; and a display electrode formed on and adjoining the top surface of the shielding mask and having a bottom surface, the bottom surface of the display electrode being shielded by the shielding mask to reduce reflection thereof, wherein the second side wall of the transparent electrode is higher than the first side wall of the shielding mask such that the second side wall of the transparent electrode has an outstanding surface used to conduct to the display electrode.

10. The PDP as claimed in claim 9, wherein the shielding mask consists of $Cr/Cr_2O_3$.

11. The PDP as claimed in claim 9, wherein the shielding mask consists of $Fe/Fe_2O_3$.

12. The PDP as claimed in claim 9, wherein the shielding mask consists of black low melting-point glass.

13. The PDP as claimed in claim 9, wherein the display electrode consists of Ag.

14. The PDP as claimed in claim 13, wherein the dielectric layer consists of lead oxide and silicon oxide.

15. The PDP as claimed in claim 13, further comprising a passivation layer on the dielectric layer.

16. The PDP as claimed in claim 15, wherein the passivation layer consists of MgO.

17. A plasma display panel (PDP), comprising:

a glass substrate;

a shielding mask formed on the glass substrate, the shielding mask having a first top surface and a first side wall;

a transparent electrode having a second top surface and a second side wall formed on the glass substrate, wherein the second side wall of the transparent electrode adjoins the first side wall of the shielding mask;

a display electrode formed on and adjoining the top surface of the shielding mask and having a bottom surface, the bottom surface of the display electrode being shielded by the shielding mask to reduce reflection thereof, wherein the display electrode has a first bottom portion overlaying the shielding mask and not overlaying the transparent electrode, and a second bottom portion overlaying the transparent electrode and not overlaying the shielding mask, and wherein the display electrode conducts to the top surface of the transparent electrode.

18. The PDP as claimed in claim 17, wherein the shielding mask consists of $Cr/Cr_2O_3$.

19. The PDP as claimed in claim 17, wherein the shielding mask consists of $Fe/Fe_2O_3$.

20. The PDP as claimed in claim 17, wherein the shielding mask consists of black low melting-point glass.

21. The PDP as claimed in claim 17, wherein the display electrode consists of Ag.

22. The PDP as claimed in claim 21, wherein the dielectric layer consists of lead oxide and silicon oxide.

23. The PDP as claimed in claim 21, further comprising a passivation layer on the dielectric layer.

24. The PDP as claimed in claim 23, wherein the passivation layer consists of MgO.

25. A method for making a PDP, comprising the steps of:

(a) providing a glass substrate;

(b) forming a shield mask on the glass substrate, wherein the shielding mask has a top surface and a first side wall;

(c) forming a transparent electrode on the glass substrate, the transparent electrode having a second side wall, wherein the second side wall of the transparent electrode contacts the first side wall of the shielding mask, and the second side wall of the transparent electrode is higher than the first side wall of the shielding mask, such that the second side wall of the transparent electrode has a projecting portion which projects beyond the first side wall of the shielding mask;

(d) forming a display electrode on the top surface of the shielding mask, the display electrode contacting the projecting portion of the transparent electrode, whereby a bottom of the display electrode is shielded by the shielding mask to reduce reflection thereof.

* * * * *